US005905373A

United States Patent [19]

Pan et al.

[11] Patent Number: 5,905,373

[45] Date of Patent: May 18, 1999

[54] SERIAL-MODULIZED HIGH VOLTAGE TRANSFORMER

[75] Inventors: Tsung-Ming Pan, Ping Tung; Jang-Tzeng Lin, Hsinchu, both of Taiwan

[73] Assignee: Industrial Technology Research Institute, Hsinchu Hsien, Taiwan

[21] Appl. No.: 09/004,734

[22] Filed: Jan. 9, 1998

[51] Int. Cl.[6] ..... H01F 30/12

[52] U.S. Cl. ..... 323/361

[58] Field of Search ..... 323/355, 361; 363/65, 71; 336/65, 170, 210

[56] References Cited

U.S. PATENT DOCUMENTS

| | | | |
|---|---|---|---|
| 4,555,681 | 11/1985 | Dominick et al. | 333/112 |
| 4,912,372 | 3/1990 | Mongoven et al. | 315/122 |
| 5,373,433 | 12/1994 | Thomas | 363/43 |
| 5,508,905 | 4/1996 | Reichard | 363/71 |

*Primary Examiner*—Matthew Nguyen
*Attorney, Agent, or Firm*—McDermott, Will & Emery

[57] ABSTRACT

A voltage transforming apparatus for receiving a system input voltage and generating a system output voltage is disclosed herein. The voltage transforming apparatus includes the following devices. Transforming device that is to generate module output voltage responsive to the rate of change of the magnetic flux induced by the system input voltage. The voltage transforming device including a first terminal having a first voltage and a second terminal having a second voltage. The first voltage is higher than the second voltage, and the output voltage of the voltage transforming device is generated responsive to the difference between the first voltage and the second voltage. The voltage transforming device is mechanically connected to prevent the movement. Coupling device for electrically coupling the voltage transforming device to form a serial connected voltage transforming device. The serial connected voltage transforming device including a top voltage transforming device and a bottom voltage transforming device. The difference of the voltage level of the first terminal of the top voltage transforming device and the second terminal of the bottom voltage transforming device is equal to the system output voltage. In the serial connected voltage transforming device, the first terminal of one voltage transforming device is connected to the second terminal of the other voltage transforming device.

11 Claims, 9 Drawing Sheets

SERIAL-MODULIZED HIGH VOLTAGE TRANSFORMER

FIELD OF THE INVENTION

The present invention relates to a serial connected voltage transformer, and particularly relates to a serial-modulized high voltage transformer.

BACKGROUND OF THE INVENTION

The principle of the operation of the voltage transformer is shown in FIG. 1, which depicts two coils wound on the same core. The power supply 100 and core 103 are connected by the first coil, namely, primary winding 104. Similarly, the load 105 and the core 103 are connected by the second coil, namely, secondary winding 106. The voltage of the power supply 100 on the terminal $a_1$ and $b_1$ is $v_1$, and the current flowing into the primary winding 104 is the primary current $i_1$. The terminals of the secondary winding 106 are $a_2$ and $b_2$.

The primary current $i_1$ in the core 103 induces the magnetic flux $\phi$, and then the secondary current $i_2$ is induced by the magnetic flux $\phi$ in the secondary winding 106. Finally, the secondary current flows into the secondary winding 106, and the voltage drop between terminal $a_2$ and $b_2$ is thus produced. Assuming that the magnetic flux $\phi$ passes through an N-turn coil, an induced voltage, denoted $v_2$, is related to the rate of change of the magnetic flux by $v_2=N_2\ (d\ \phi/dt)$ and ignoring the energy loss in the core, the equation $N_1i_1=N_2i_2$ is obtained. Thus, the principle of energy conservation there will be an equation $i_1v_1=i_2v_2$ and the voltage drop between the terminals $a_2$ and $b_2$, denoted $v_2$, related to the voltage drop between the terminals $a_1$ and $b_1$, is by equation (1), wherein:

$$(V_1/V_2)=(N_1/N_2) \tag{1}$$

According to equation (1), the design and the manufacturing of the primary winding and the secondary winding must take the turn ratio $(N_1/N_2)$ into account. According to the structure of solenoidal winding used in the traditional transformer, the process for manufacturing the voltage transformer could become more complex when the high voltage transformer is considered because the number of turns in each coil is very large. Furthermore, the special design of the insulation between the layers of the coils must be considered. Due to the reason mentioned above, the manufacturing and the design of the traditional high voltage transformer are very complicated. In some application, the multiple circuit is used to raise the output voltage of the voltage transformer, and the configuration of the multiple circuit is shown in FIG. 2. The output voltage of the secondary side $T_{xs}$ is assumed to be $V_M$, and the output voltage $V_M$ is fed into the multiple circuit to amplify the output voltage in every stage from the multiple circuit. Then, the output voltage of every stage of the multiple circuit can be fed into another voltage transformer to further increase the output voltage in high-power application.

In the case of switching-power-supply application, the frequency is usually between 100 kHz and 200 kHz, so the effect of the distributed capacitance must be considered carefully in the traditional high voltage transformer. In addition, the volume of the modern electronic device is shrunk to fit the need of the modern application, so the volume of the voltage transformer used in the power supply must be reduced too. Thus, the switching frequency of the power supply is increased, and the reduction of the volume of the transformer is then enabled. Furthermore, when the switching frequency is low, it is not important to ignore the parasitic effect because it is not obvious. Whereas, when the switching power is high, the consideration of the parasitic effect of the components of the transformer is critical, and the poor efficiency of the transformer as well as the modification of the feedback circuit of the transformer are very complicated.

In addition, the components used in the traditional voltage transformer are all specially designed. For example, rectifier and capacitor-use filter in high-power application must be utilized in high voltage transformer. So they are suitable to be used under high component stress. Due to the specialty, the source of the specially designed components have been a problem, and the high voltage transformer is thus very expensive.

SUMMARY OF THE INVENTION

Because the effect of the distributed capacitance in the traditional high voltage transformer must be considered In addition, the volume of the voltage transformer used in the power supply must be reduced. Thus, the switching frequency of the power supply is increased, and the reduction of the volume of the transformer is then enabled. Whereas, when the switching power is high, the consideration of the parasitic effect of the components of the transformer is critical, and the poor efficiency of the transformer as well as the modification of the feedback circuit of the transformer are very complicated.

For the reason mentioned above, a voltage transformer is presented including the following devices: Modulized transforming devices for generating a plurality of module output voltage responsive to the rate of change of the magnetic flux induced by the system input voltage. The modulized transforming device including a first terminal having a first voltage and a second terminal having a second voltage. The first voltage is higher than the second voltage. The output voltage of the modulized transforming device is generated responsive to the difference between the first voltage and the second voltage.

Mechanical connecting device for mechanically connecting between the modulized transforming device to prevent the modulized transforming device from moving.

Coupling devices for electrically coupling the modulized transforming devices to form a serial modulized transforming device. The serial modulized transforming device including a top modulized transforming device and a bottom modulized transforming device. The difference of the voltage level of the first terminal of the top modulized transforming device and the second terminal of the bottom modulized transforming device is equal to the system output voltage. In the serial modulized transforming device, the first terminal of one modulized transforming device is connected to the second terminal of the other modulized transforming device.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

It is essential to avoid the effect of the distributed capacitance and the parasitic effect when designing the high voltage transformer used in high switching frequency according to the traditional transformer. Also, the volume of the transformer must be shrunk to reduce the volume of the modern electrical devices. Furthermore, the components used in the high voltage transformer are specially designed, so the source of the specially designed components is a problem and the cost of these components are very expensive.

To solve the problems mentioned above, the serial-modulized high voltage transformer according to the present invention is utilized to lower the effect of distributed capacitance in high-frequency application. The modulized design of the transformer can reduce the cross voltage in every component of the modulized transformer, and the component stress is not as high as that in the traditional high voltage transformer. In addition, a connector is used in the connection of every modulized transformers, so that the designer of the electrical device can easily fabricate the high voltage transformer by connecting the modulized transformers in the present invention according to the designer's need of the electrical device. The summation of every modulated transformer is equal to the output voltage of the high voltage transformer in the present invention by the power supply used in the designed electrical devices.

Figure 3:
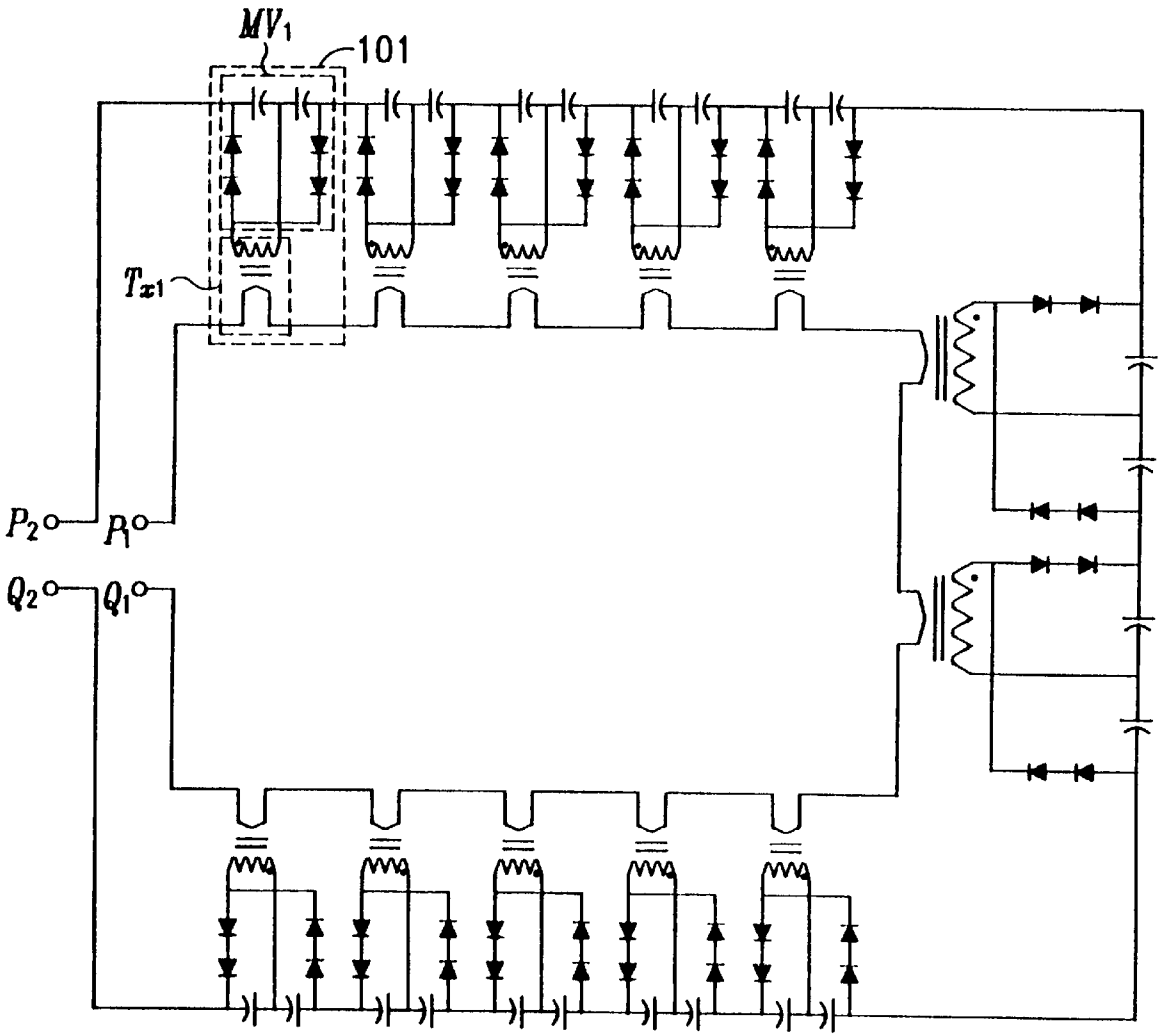
FIG. 3 illustrates the configuration of the serial-modulized high voltage transformer in the present invention.

The structure of the serial-modulized high voltage transformer in the present invention is illustrated in FIG. 3, all the modulized transformers are identical. The module 101 enclosed by the dotted line in FIG. 3 represents the structure of the modulized transformer. In some applications, different-loaded current are needed and the designer of the electrical device can use variant types of the modulized transformers in the present invention. For example, when low or medium loaded current is needed, the modulized transformer of the structure illustrated in FIG. 4A can be used. Whereas, the modulized transformer of the structure illustrated in FIG. 4B can be used to generate high-loaded current.

The circuit shown as module 101 in FIG. 3 is a multiple circuit, which is also an amplifier and a rectifier. Module 101 includes transformer TX1 and voltage-amplifying circuit $MV_1$. Transformer TX1 includes the primary side and the secondary side. The secondary side is coupled to the voltage-amplifying circuit $MV_1$ to input the signal to be amplified. Thus the voltage-amplifying circuit $MV_1$ outputs a voltage signal to show that is amplified. The terminals P1 and Q1 in FIG. 3 represent the terminals of the primary winding in the present invention, and the terminals P2 and Q2 represent the output terminals of the secondary winding in the present invention. Terminals P2 and Q2 are connected to the load (not shown in FIG. 3). By observing FIG. 3, it is clear that the plurality of the modules have the same primary sides because the output terminals of every module are connected in series and the output voltage of the serial-modulized high voltage transformer is equal to the summation of all the plurality of modules.

Figure 1:
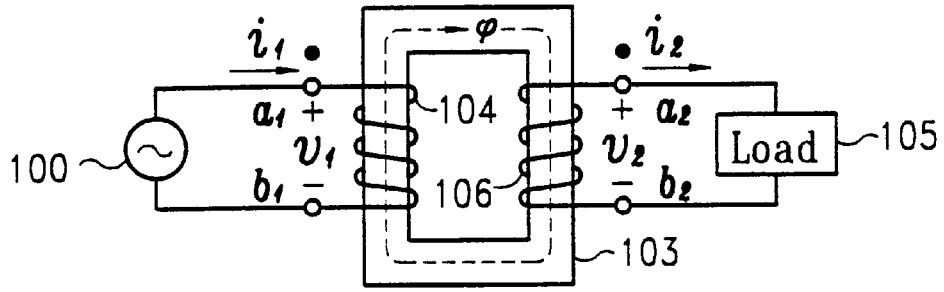
FIG.1 (Prior Art)
FIG. 1 illustrates the principle of the traditional voltage transformer of conventional winding.
Figure 2:
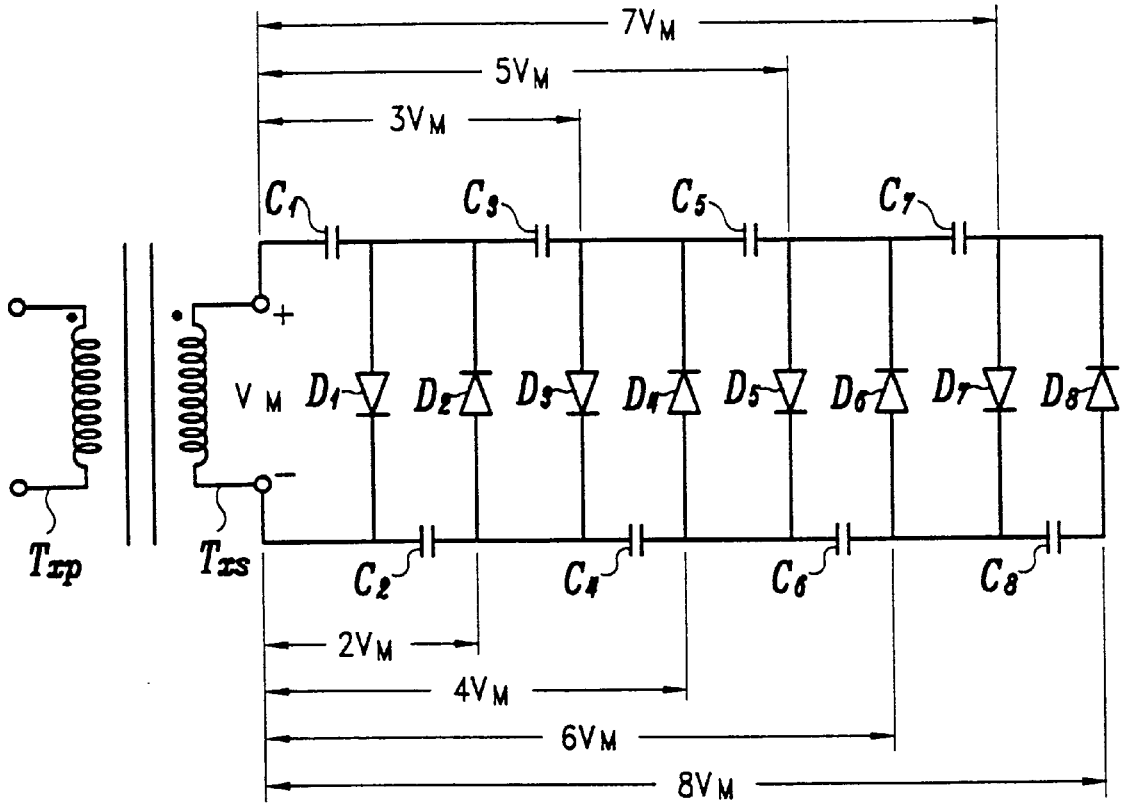
FIG.2 (Prior Art)
FIG. 2 illustrates the configuration of the traditional high voltage transformer.
Figure 4A:
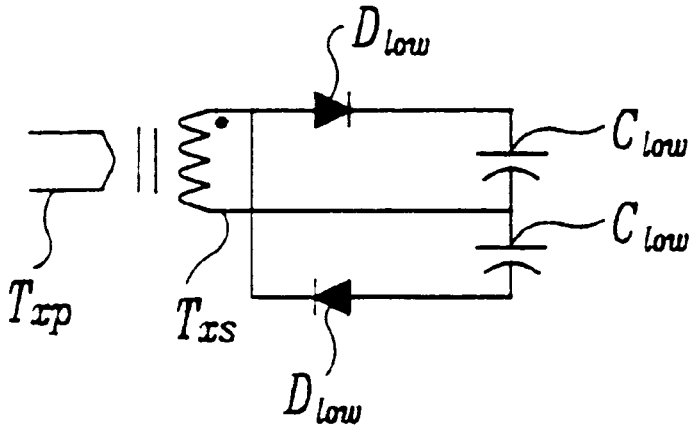
FIG. 4A illustrates the configuration of the module suitable for low or medium load current, the module is an element of the serial-modulized high voltage transformer in the present invention.
Figure 4B:
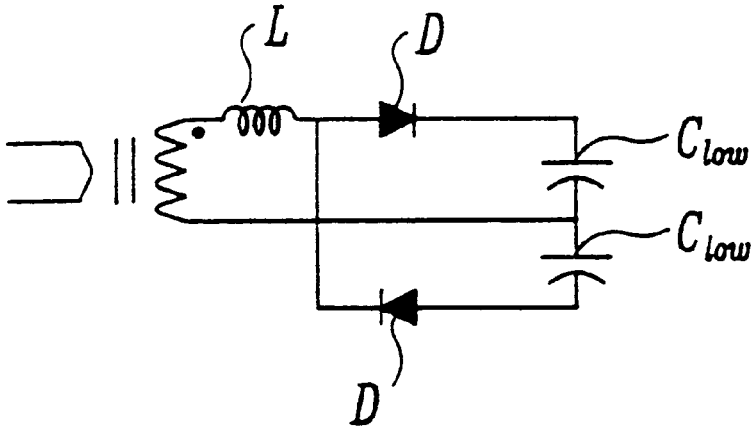
FIG. 4B illustrates the configuration of the module suitable for high load current, the module is an element of the serial-modulized high voltage transformer in the present invention.

When medium or low load current, such as 200–300 mA or below is needed, the configuration of the module that can be utilized in this invention is shown in FIG. 4A, in which the diode $D_{low}$ is suitable for the medium or low load current. The capacitor $C_{low}$ in FIG. 4A is of the order nF (nano Farad). The primary side of the transformer of the module shown in FIG. 4A is $T_{xp}$ and the secondary side is $T_{xs}$. When high load current is needed, the configuration of the module that can be utilized in this invention is shown in FIG. 4B, in which the diode $D_{low}$ and the capacitor $C_{low}$ are the same as those in FIG. 4A except the cylindrical coil L that is used to increase the tolerance of high load current. The spec of the cylindrical coil L is of the order $\mu$ H (micro Henry). The configuration shown in FIG. 4B is one of the configurations that can increase the tolerance of high load current. Besides, the tolerance of the load current can be increased by replacing all the elements in FIG. 4A by similar elements that can bear higher load current operation (above 200–300 mA). The voltage-amplifying circuit $MV_1$ shown in FIG. 3 can be replaced by the multiple circuit shown in FIG. 2, and the various output voltage, e.g. 3, 4, . . . 8 times input voltage, can be chosen by selecting the output terminals of the multiple circuit.

From the aforementioned statement, it is obvious that the present invention utilize a primary side as the common primary side of the plurality of modules. The output voltage of the secondary side is amplified by the voltage-amplifying circuit of the plurality of modules, then the output terminals of the plurality of modules are connected in series to make the output of the serial-modulized high voltage transformer reach the designed high voltage. Science the number of turns on the core of the transformer in every module is less than that of the prior art, the effect of the distributed capacitance can be ignored. The designer of the power supply of the electrical device can acquire any output voltage by connecting any number of modules in series.

Figure 5:
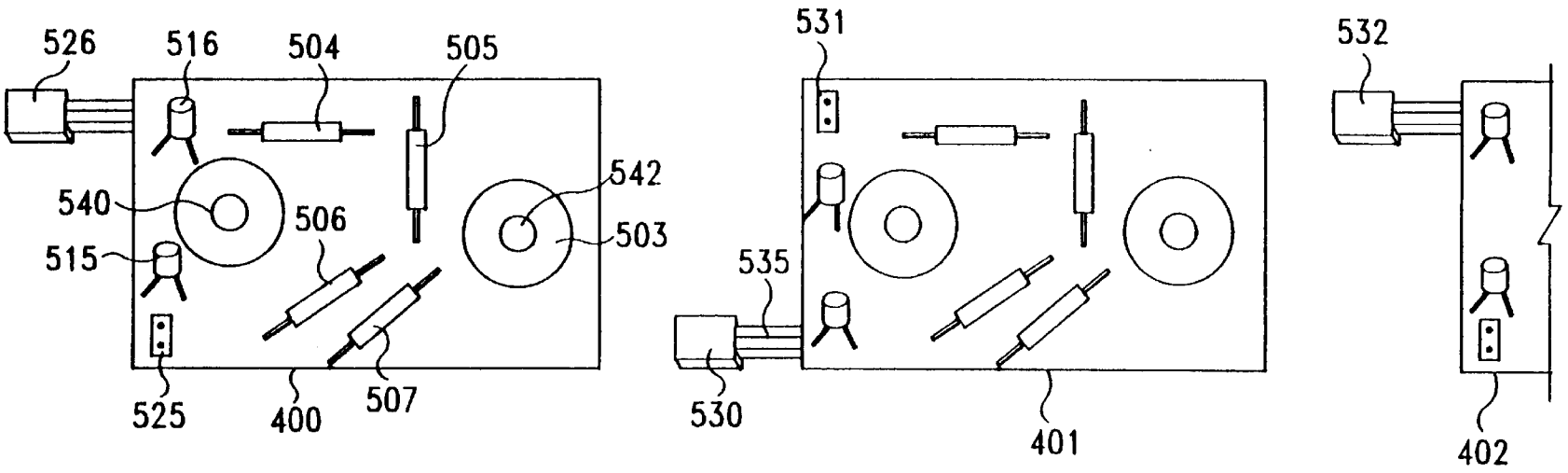
FIG. 5 illustrates the outlook of the module according to one preferred embodiment in the present invention.

The configuration of the module 101 is shown in FIG. 3, and the outlook of the module 101 is shown as module 400 and 401 in FIG. 5. For the convenience in manufacture, the one embodiment carries out module 101 by module 400 and 401. There are many different circuits that can have the same function as module 101 in FIG. 3, and modules 400, 401 and 402 are just an embodiment. The configuration of the module 400 and 401 are the same except the layout of output terminals, whereas the configuration of the module 400 and 402 are identical, so a part of module 402 is not shown in FIG. 5.

Figure 6:
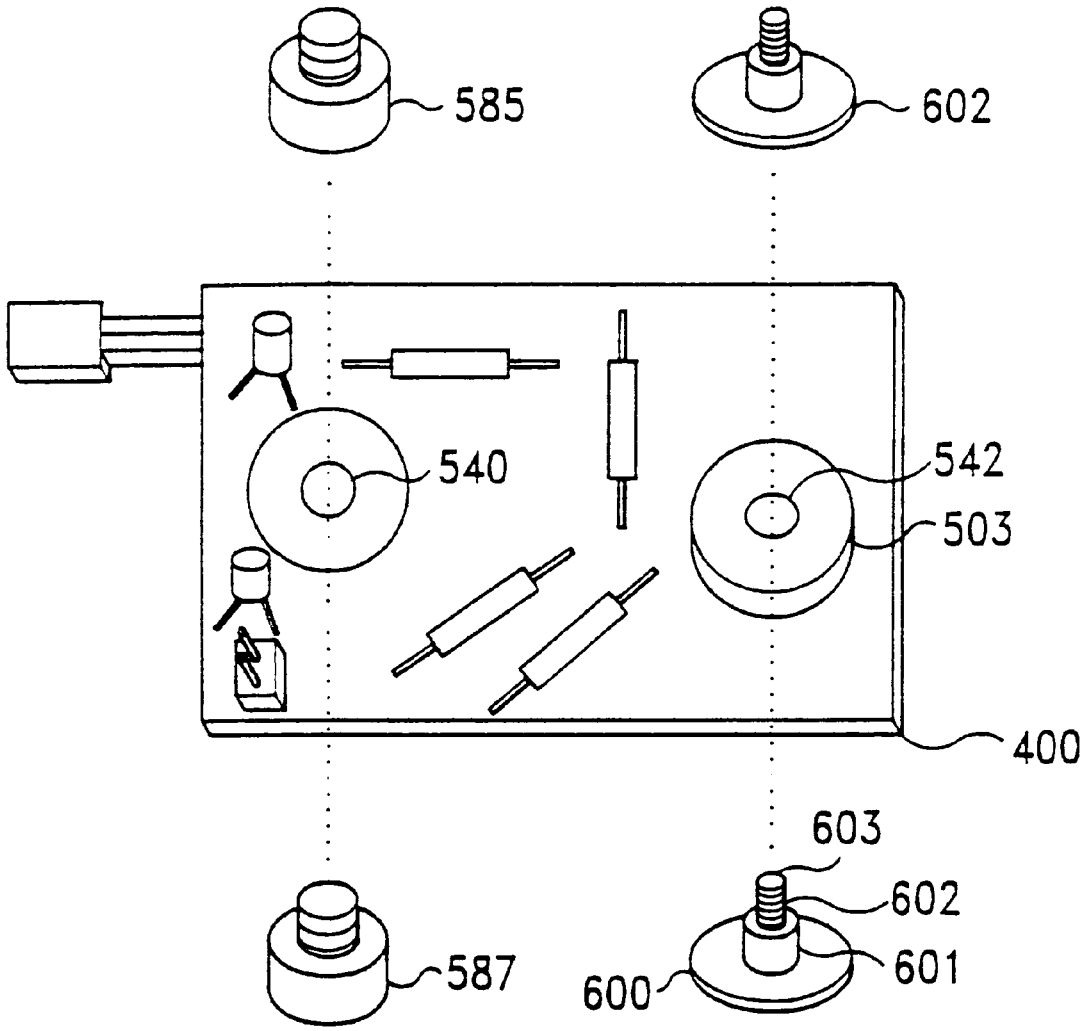
FIG. 6 illustrates the explosive view of the outlook of the modulized transformer and fixing device in the serial-modulized high voltage transformer according to one preferred embodiment in the present invention.

The secondary winding 503 in FIG. 5 is the front view of the secondary side of the transformer $T_{x1}$ shown in FIG. 3. The diode 504, 505, 506 and 507 shown in FIG. 5 are the outlook of the four diodes of the voltage-amplifying circuit $MV_1$ in FIG. 3. The capacitors 515 and 516 are the outlook of the capacitor of voltage amplifying circuit $MV_1$ in FIG. 3. To add the output voltage of all the modules together, the module 400 is connected in series with the other module by the male header 525 and the female header 526. The connection of the modules are carried out by coupling the male header of the residential module to the female header of the former module, and by coupling the female header of the residential module to the latter module. As shown in FIG. 5, the male header 525 of the module 400 is electrically coupled to the female header 530 of the module 401, and the male header 531 of module 401 is electrically coupled to the female header 532 of module 402. Referring to FIG. 5, the female header 530 is connected to the module 401 by cable 535. The hole at the center of the secondary winding 503 is the internal-fixing hole 542, which is used to offer a cavity for fixing module 400. In addition, the external-fixing hole 540 of module 400 offers the cavity for the external-fixing device 585 to penetrate and fix module one by one. The coil-fixing device 600 in FIG. 6 is to perforate the internal-fixing hole 542 and fix module 400.

Figure 7A:
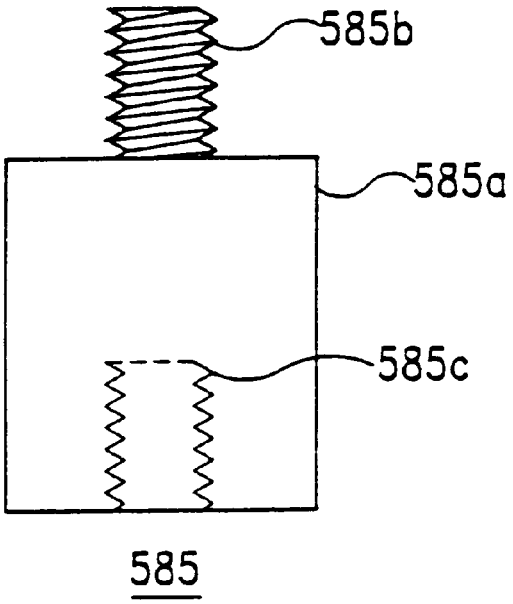
FIG. 7A illustrates the front view of the external fixing device that is used to connect and fix the modulized transformers of the one preferred embodiment in the present invention.
Figure 7B:
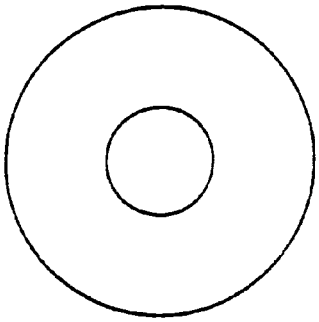
FIG. 7B illustrates the top view of the external fixing device that is used to connect and fix the modulized transformers of the one preferred embodiment in the present invention.
Figure 7C:
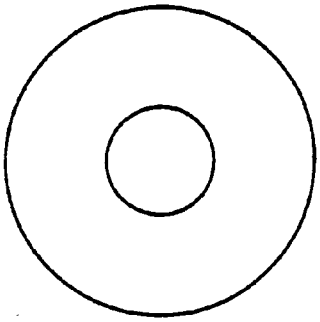
FIG. 7C illustrates the bottom view of the external fixing device that is used to connect and fix the modulized transformers of the one preferred embodiment in the present invention.
Figure 8A:
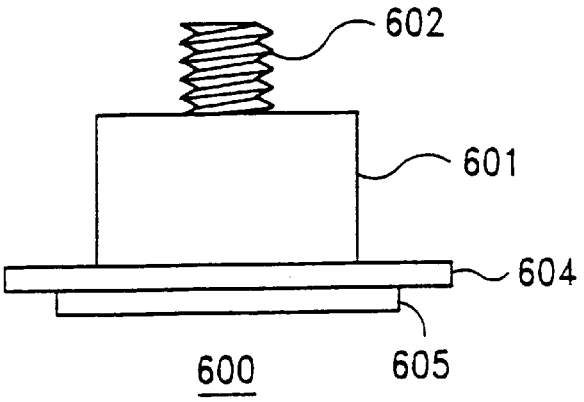
FIG. 8A illustrates the front view of the internal fixing device that is used to connect and fix the modulized transformers as well as the secondary winding of the one preferred embodiment in the present invention.
Figure 8B:
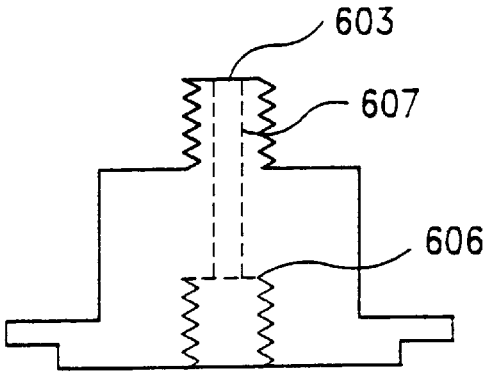
FIG. 8B illustrates the cross-sectional view of the internal fixing device that is used to connect and fix the modulized transformers as well as the secondary winding of the one preferred embodiment in the present invention.
Figure 8C:
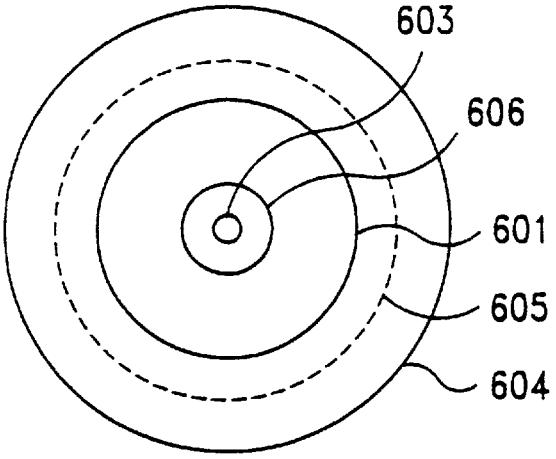
FIG. 8C illustrates the bottom view of the internal fixing device that is used to connect and fix the modulized transformers as well as the secondary winding of the one preferred embodiment in the present invention.

In a fully finished serial-modulized high voltage transformer, every module is fixed by external-fixing device 585 and coil-fixing device 600. To illustrate the physical connection and the fixing of the module, the fixed module is shown in FIG. 6 by explosive view. To grasp module 400, an external-fixing device 585 beneath module 400 penetrates external-fixing hole 540 to connect the other external-fixing device 585 above module 400, and the coil-fixing device 600 beneath the module 400 perforate the internal-fixing hole 542 to connect the other coil-fixing device 600 above the module 400. The two external-fixing devices 585 are identical in structure, and the two coil-fixing devices 600 are also identical in structure. All the plurality of the modules of the serial-modulized high voltage transformer is fixed by the similar method mentioned above. Coil-fixing device 600 does not only fix module one to the other, but also attaches the secondary winding 503 to the module between the two coil-fixing devices 600. The coil-fixing device 600 includes an internal protrusive cylinder 601, connecting a cylinder 602 and a hollow 603, which is on the top of the connecting cylinder 602. The structure and function of every part of the external-fixing device 585 and coil-fixing device 600 are described below:

The front view of external-fixing device 585 is shown in FIG. 7A, whereas the top view is shown in FIG. 7B and the bottom view is shown in FIG. 7C. Referring to FIG. 7A, external-fixing device 585 includes external-distance-keeping cylinder 585*a* and external-protrusive spiral 585*b*. The external-distance-keeping cylinder 585*a* has an external cavity 585*c*, and both the surface of the external protrusive spiral 585*b* and the external cavity 585*c* have the curl to make external protrusive spiral 585*b* coupled mechanically to the external cavity 585*c*. Thus external-fixing device is able to be connected by one and the other. FIG. 8A is the front view of the coil-fixing device. The coil-fixing device 600 in FIG. 8A includes the internal protrusive cylinder 601, connecting cylinder 602, hollow 603 (not shown), coil-fixing device bottom plate 604 and under plate 605. The surface of the connecting cylinder 602 has the curl. The outer radius of the internal protrusive cylinder 601 is the same as the inner radius of the secondary winding 503 and the radius of the internal-fixing hole 542. Thus, the coil-fixing device can fasten the secondary winding 503, fix and connect all the modules. The cross-sectional view of the coil-fixing device 600 is shown in FIG. 8B, in which the curl on the surface of the internal cavity 606 is used to be coupled mechanically to the curl on the surface of the connecting cylinder 602 of the other coil-fixing device. In addition, the transmission line in the primary side of the transformer penetrates the internal channel 607 connecting with the internal cavity 606 and the hollow 603, so the plurality of the secondary sides on the plurality of transformer have the same primary side. The outer radius of the connecting cylinder 602 and the inner radius of the internal cavity 606 are identical. FIG. 8C is the bottom view of the coil-fixing device 600.

Figure 9:
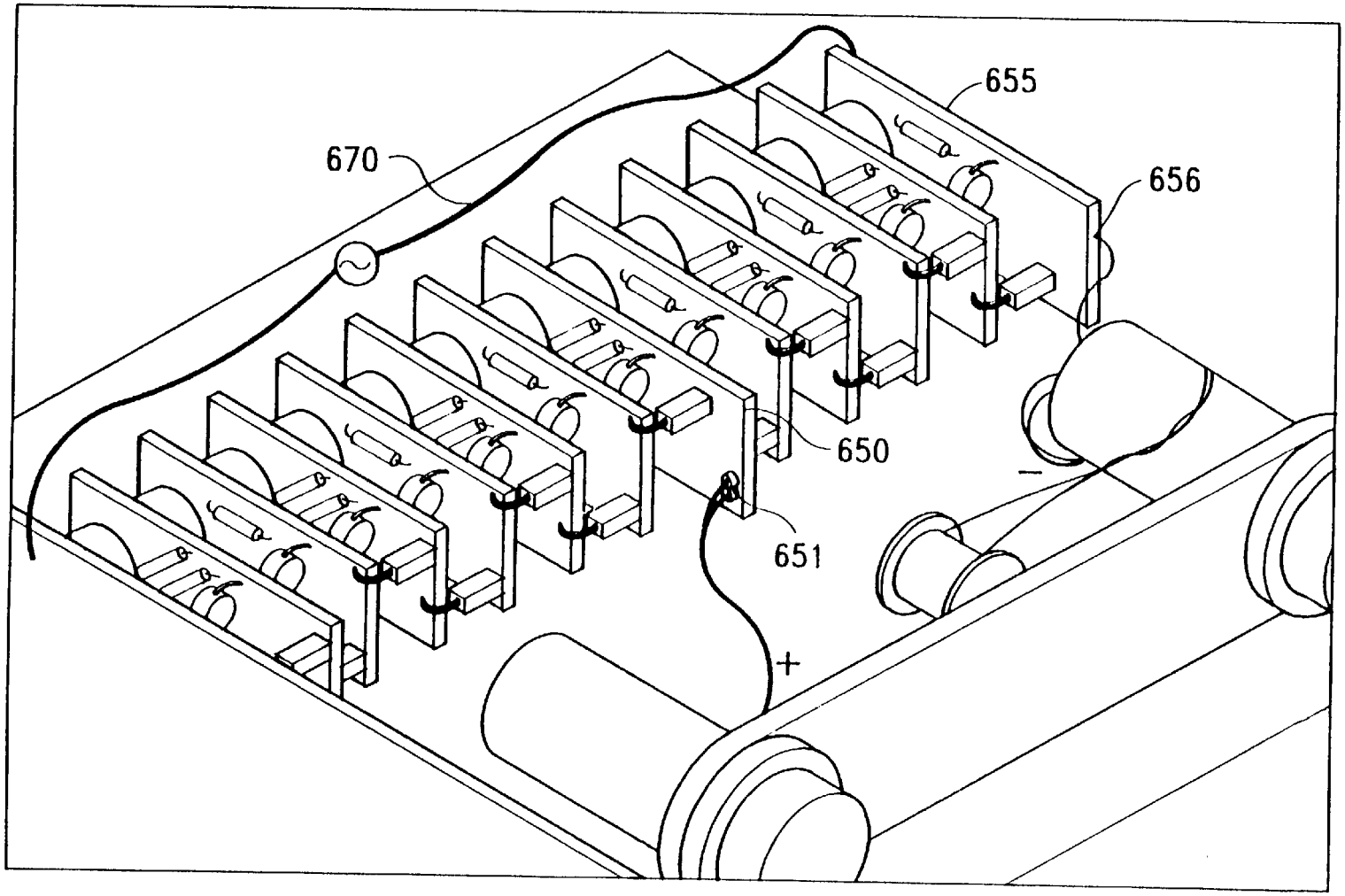
FIG. 9 illustrates the outlook of the connected serial-modulized high voltage transformer of the one preferred embodiment in the present invention.

Referring to FIG. 9, the serial connected module is fixed by both the external-fixing device and the coil-fixing device. Taking the male header 651 of the first module 650 and the female header 656 of the last module 655 of the serial connected modules as the output terminals, the output voltage of the serial connected modules is then equal to the summation of all the modules. In FIG. 9, the primary winding 670 penetrates every module via the center of the secondary winding-internal-fixing hole 542. The electrical as well as the mechanical configuration of all modules are identical, except the area of the first module 651 and the last module 656 are larger for the convenience of the connection of the output terminals. The arrangement of the serial connected modules is not confined to the connection of the one embodiment in the present invention. If the designer of the power supply of the electrical device need to reduce the length of the serial connected modules, the designer can arrange the serial connected modules in two series.

The electrical and mechanical configuration of the one embodiment is only an example to implement the present invention. For example, if the external-fixing device is spared and the secondary winding can still be fastened to the module. Thus, this type of module can be used to implement the serial connected modules in the present invention. Besides, the module can be implemented by the configuration shown in FIG. 10, in which the module 700 has a male header 702 and a female header 703 coupled electrically to the multiple circuit 705. Two conventional U-cores are connected to form a rectangular core 710, which is fixed to the circuit board of the module 700 by the fastening strip 715. A cavity 720 is on the print board of the module 700 at the center of the rectangular core 710. The insulating cube 725 penetrates the cavity 720 to fasten the rectangular core 710 and the module 700 in a serial connected modules. The output of the secondary winding 730 of the module 700 is fed to the multiple circuit 705 to change the output voltage, and to output via male header 702 and female header 703. The principle of the other embodiment of the module in the present invention is the same as that of the one embodiment.

Figure 10:
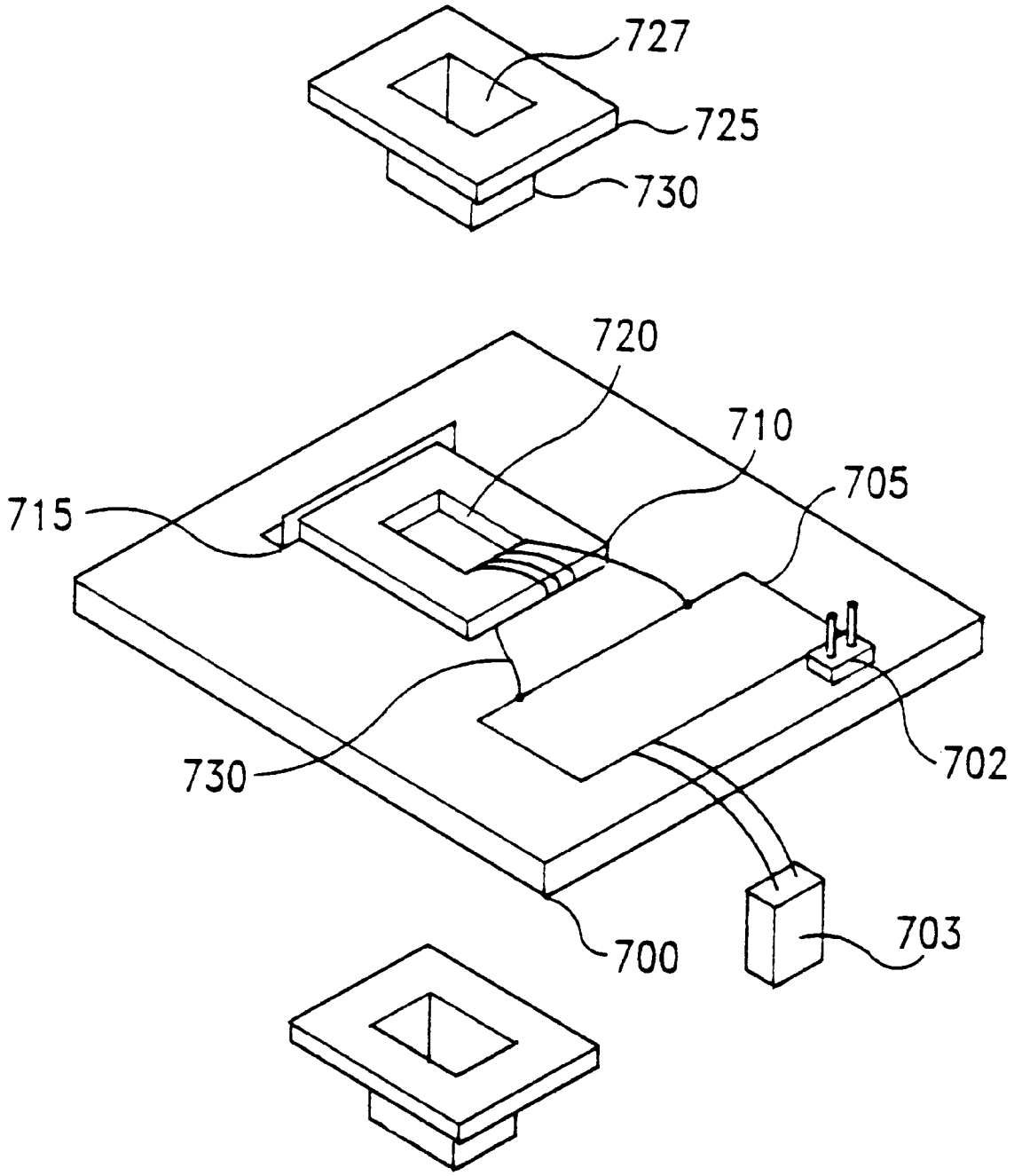
FIG. 10 illustrates the explosive view of the outlook of the modulized transformer and fixing device in the serial-modulized high voltage transformer according to the other preferred embodiment in the present invention.

The configuration of the insulating cube is shown in FIG. 10, and the connecting cavity 727 is to be connected to the bottom of the insulating cube of the former module in a serial connected modules. The bottom of the insulating cube 725 is a penetrating terminal 730, which is to perforate the cavity 720 to connect to the connecting cavity of another insulating cube of the latter module in the serial connected modules.

Although specific embodiments have been illustrated and described, it will be obvious to those skilled in the art that various modification may be made, such as the shape of the core, the manner of fixing the core and the type of transformer in the module. If the voltage transformer is modulized and connected to each other to sum up the output voltage of every module, this kind of apparatus is not departing from the spirit which is intended to be limited solely by the appended claims.

What is claimed is:

1. A voltage transforming apparatus for receiving a system input voltage and then generating a system output voltage, said voltage transforming apparatus comprising:

a plurality of pieces of voltage transforming means for generating a plurality of module output voltage responsive to the rate of change of the magnetic flux induced by said system input voltage, said voltage transforming means comprising a first terminal having a first voltage and a second terminal having a second voltage, said first voltage is higher than said second voltage, the output voltage of said voltage transforming means is responsive to the difference between said first voltage and said second voltage, said plurality of pieces of voltage transforming means are mechanically connected to prevent the movement of any one of said plurality of pieces of voltage transforming means; and coupling means for electrically coupling said plurality of pieces of voltage transforming means to form serial connected voltage transforming means, said serial connected voltage transforming means comprising a top voltage transforming means and a bottom voltage transforming means, the difference of the voltage level of said first terminal of said top voltage transforming means and said second terminal of said bottom voltage transforming means is equal to said system output voltage, in said serial connected voltage transforming means, said first terminal of one voltage transforming means is connected to said second terminal of the other voltage transforming means.

2. Apparatus as claim 1, wherein every one of said plurality of pieces of voltage transforming means comprises:

modulized transforming means for generating said module output voltage responsive to the rate of change of the magnetic flux induced by said system input voltage; and mechanical connecting means for mechanical connecting said plurality of pieces of voltage transforming means to prevent the movement of said voltage transforming means in said serial connected voltage transforming means.

3. Apparatus as claim 2, wherein said modulized transforming means comprises:

a module transformer winding for generating a module midterm voltage responsive to the rate of change of the magnetic flux induced by said system input voltage; and a module multiple circuit for amplifying said module midterm voltage to generate said module output voltage, said module multiple circuit is electrically coupled to said module transformer winding.

4. Apparatus as claim 3, wherein said module transformer winding has a cavity at the center, said mechanical connecting means penetrates said module transformer winding, said inner radius of said cavity is the same as the outer radius of said mechanical connecting means.

5. Apparatus as claim 2, wherein said mechanical connecting means is a cube comprising:

a front connecting terminal for penetrating said voltage transforming means to connect to a first mechanical connecting means; and a back connecting terminal for penetrating said voltage transforming means to connect to said front connecting terminal of a second mechanical connecting means, the inner radius of said back connecting terminal is equal to the outer radius of said front connecting terminal.

6. Apparatus as claim 1, wherein said coupling means comprises:

a male header for electrically coupling to said first terminal; and a female header for electrically coupling to said second terminal.

7. A voltage transforming apparatus for receiving a system input voltage and then generating a system output voltage, said voltage transforming apparatus comprising:

a plurality of modulized transforming means for generating a plurality of module output voltage responsive to the rate of change of the magnetic flux induced by said system input voltage, said modulized transforming means comprising a first terminal having a first voltage and a second terminal having a second voltage, said first voltage is higher than said second voltage, the output voltage of said modulized transforming means is responsive to the difference between said first voltage and said second voltage;

a plurality of mechanical connecting means for mechanical connecting said plurality of modulized transforming means to prevent the movement of said modulized transforming means; and coupling means for electrically coupling said plurality of modulized transforming means to form a serial modulized transforming means, said serial modulized transforming means comprising a top modulized transforming means and a bottom modulized transforming means, the difference of the voltage level of said first terminal of said top modulized transforming means and said second terminal of said bottom modulized transforming means is equal to said system output voltage, in said serial modulized transforming means, said first terminal of one modulized transforming means is connected to said second terminal of the other modulized transforming means.

8. Apparatus as claim 7, wherein said modulized transforming means comprises:

a module transformer winding for generating a module midterm voltage responsive to the rate of change of the magnetic flux induced by said system input voltage; and a module multiple circuit for amplifying said module midterm voltage to generate said module output voltage, said module multiple circuit is electrically coupled to said module transformer winding.

9. Apparatus as claim 8, wherein said module transformer winding has a cavity at the center, said mechanical connecting means penetrates said module transformer winding, said inner radius of said cavity is the same as the outer radius of said mechanical connecting means.

10. Apparatus as claim 8, wherein said mechanical connecting means is a cube comprises:

a front connecting terminal for penetrating said modulized transforming means to connect to a first mechanical connecting means; and a back connecting terminal for penetrating said modulized transforming means to connect to said front connecting terminal of a second mechanical connecting means, the inner radius of said back connecting terminal is equal to the outer radius of said front connecting terminal.

11. Apparatus as claim 7, wherein said coupling means comprises:

a male header for electrically coupling to said first terminal; and a female header for electrically coupling to said second terminal.

* * * * *